US007441974B2

(12) United States Patent
Gueret

(10) Patent No.: US 7,441,974 B2
(45) Date of Patent: Oct. 28, 2008

(54) PACKAGING AND APPLICATOR DEVICE

(75) Inventor: Jean-Louis H. Gueret, Paris (FR)

(73) Assignee: L'Oréal, Paris (FR)

( * ) Notice: Subject to any disclaimer, the term of this patent is extended or adjusted under 35 U.S.C. 154(b) by 366 days.

(21) Appl. No.: 10/962,877

(22) Filed: Oct. 13, 2004

(65) Prior Publication Data

US 2005/0141951 A1 Jun. 30, 2005

Related U.S. Application Data

(60) Provisional application No. 60/514,611, filed on Oct. 28, 2003.

(30) Foreign Application Priority Data

Oct. 13, 2003 (FR) ..... 03 11962

(51) Int. Cl.
*B05C 1/06* (2006.01)

(52) U.S. Cl. ..... 401/205; 401/202

(58) Field of Classification Search ..... 401/196–207
See application file for complete search history.

(56) References Cited

U.S. PATENT DOCUMENTS

| | | | | |
|---|---|---|---|---|
| 2,853,727 | A | 9/1958 | Nadai | |
| 3,010,138 | A | 11/1961 | Nadai | |
| 3,340,561 | A * | 9/1967 | Schwartzman | 251/321 |
| 4,747,720 | A * | 5/1988 | Bellehumeur et al. | 401/205 |
| 4,889,441 | A * | 12/1989 | Tice | 401/131 |
| 5,230,579 | A | 7/1993 | Klawson et al. | |
| 5,967,685 | A | 10/1999 | De Laforcade | |
| 6,692,173 | B2 | 2/2004 | Gueret | |
| 6,773,193 | B2 | 8/2004 | Delage | |
| 2001/0031168 | A1 | 10/2001 | Gueret | |
| 2001/0033766 | A1 | 10/2001 | Gueret | |
| 2002/0057939 | A1 | 5/2002 | Gueret | |
| 2003/0129016 | A1 | 7/2003 | Gueret | |

FOREIGN PATENT DOCUMENTS

| | | |
|---|---|---|
| EP | 0 081 816 | 6/1983 |
| EP | 0 373 408 | 6/1990 |

(Continued)

OTHER PUBLICATIONS

Co-pending Application—Title: Substance Packaging and Applicator Device Inventors(s): Jean-Louis H. Gueret U.S. Filing Date: Oct. 13, 2004.

(Continued)

*Primary Examiner*—David J Walczak
(74) *Attorney, Agent, or Firm*—Finnegan, Henderson, Farabow, Garrett & Dunner, LLP

(57) ABSTRACT

A device for packaging and applying a substance may include a receptacle for containing the substance and an applicator member having a retention skirt configured to be fastened to the receptacle. The retention skirt may extend in the direction of an axis and may have a radial inner face. The receptacle may include a support in contact with the radial inner face of the retention skirt. The support may contact the radial inner face of the skirt along at least a fraction of the support's height along the axis without contacting the radial inner face in every radial location with respect to the axis.

43 Claims, 6 Drawing Sheets

FOREIGN PATENT DOCUMENTS

| | | |
|---|---|---|
| EP | 0 872 193 | 10/1998 |
| EP | 1 312 280 | 5/2003 |
| FR | 1 329 884 | 6/1963 |
| FR | 1 461 651 | 2/1966 |
| FR | 1 461 652 | 11/1966 |
| FR | 2 800 041 | 4/2001 |
| GB | 857 968 | 1/1961 |
| JP | 01-135002 | 9/1989 |
| JP | 2001-269221 | 10/2001 |

OTHER PUBLICATIONS

English language Derwent Abstract of EP 0 081 816, Jun. 22, 1983.
English language Derwent Abstract of EP 0 373 408, Jun. 20, 1990.
English language Derwent Abstract of EP 1 312 280, May 21, 2003.
English language Derwent Abstract of FR 2 800 041, Apr. 27, 2001.

* cited by examiner

PACKAGING AND APPLICATOR DEVICE

This application claims the benefit of priority under 35 U.S.C. § 119(e) of U.S. provisional application No. 60/514,611, filed Oct. 28, 2003.

The present invention relates to a device for packaging and applying a substance. For example, the invention may relate to a device comprising a receptacle, an applicator member including a retention skirt for fastening to the receptacle, and a support configured to hold the applicator member on the receptacle.

European patent application no. 1 312 280 A1 discloses a device including an applicator member having a retention skirt. The retention skirt has radial outer and inner faces that come into contact with an outer skirt of a support and with a substance feed chimney, respectively.

In such a device, an increase in the inside diameter of the feed chimney may increase the size of the applicator member and, therefore, may cause the substance to be discharged in excessive quantities during utilization. On the other hand, if only the diameter of the retention skirt is increased, then the retention skirt may be held only by the outer skirt of the support, and, under certain circumstances, it may cause the applicator member to be separated from the support during utilization.

In addition, if the diameter of the feed chimney is too small, the substance may be poorly distributed over the applicator member, especially when the substance is in the form of a powder.

Therefore, there exists a need for a device that may supply an appropriate feed amount of substance to the applicator member.

There also exists a need for a device that may provide a reliable retention of the applicator member to the support.

Although the present invention may obviate one or more of the above-mentioned needs, it should be understood that some aspects of the invention may not necessarily obviate one or more of those needs.

In the following description, certain aspects and embodiments will become evident. It should be understood that the invention, in its broadest sense, could be practiced without having one or more features of these aspects and embodiments. It should be understood that these aspects and embodiments are merely exemplary.

In one aspect of the invention, as embodied and broadly described herein, the invention may provide a device for packaging and applying a substance, that may include a receptacle for containing the substance and an applicator member having a retention skirt configured to be fastened to the receptacle. The applicator member may be elastically compressible. The retention skirt may extend in the direction of an axis and may have a radial inner face. The receptacle may include a support in contact with the radial inner face of the retention skirt. The support may contact the radial inner face of the skirt along at least a fraction of the support's height along the axis without contacting the radial inner face in every radial location with respect to the axis (i.e., the support may contact the radial inner face over less than one complete turn about the axis, for at least a fraction of the height of the support along the axis).

In some aspects, the applicator member may be held to the support by, for example, being clamped between two walls of the support, while enabling the applicator member to be supplied with an amount of substance by appropriately configuring at least a section of the support that provides the flow of substance towards the applicator member.

According to another aspect of the invention, the radial inner face of the retention skirt may be circularly symmetrical about the axis. Other shapes of the retention skirt may also be possible as variants.

In still another aspect, the support may comprise a feed chimney having a non-circular cross-section that may be configured to bear against the radial inner face of the retention skirt. For example, the cross-section of the feed chimney may have a shape of polygon (e.g., triangle, square, or hexagon). The chimney may also come into contact with the retention skirt via corner edges of the polygon.

In an aspect, the support may comprise another chimney inside the feed chimney. This additional chimney may create, for example, an additional head loss.

In some aspects, the support may comprise one or more uprights or chimneys extending in contact with the radial inner face of the retention skirt. For example, in an embodiment, the one or more uprights may be connected to the chimney by one or more radially extending walls. The uprights may constitute, for example, portions of one or more cylinders. The uprights may also constitute cylinders that may be coaxial with the feed chimney.

In still another aspect of the invention, the support may comprise radial fins having respective outer edges bearing against the radial inner face of the retention skirt. These fins may be connected to the feed chimney.

According to some aspects of the invention, the support may comprise at least two feed chimneys. Each of these chimneys may be configured to bear against the radial inner face of the retention skirt via at least one generator line. These chimneys may or may not be concentric with respect to one another. The chimneys may have a cross-section that is circular, kidney-shaped, or any other suitable shape. The cross-section of the chimneys may or may not be continuous. In an exemplary embodiment, the support may comprise at least three chimneys.

In an aspect of the invention, the retention skirt may comprise a radial outer face opposite the radial inner face, and the support may comprise an outer skirt configured to at least partially contact the radial outer face of the retention skirt.

In another aspect, the support may comprise a part configured to be fitted onto a body of the receptacle. For example, the support may comprise a fastening member configured to engage with a neck of the receptacle, such that the support can be fastened (e.g., snap-fastening or screw-fastening) onto the neck of the receptacle. In a variant, the support may be made integrally with the body of the receptacle by, for example, molding a plastic material.

In some aspects of the invention, the applicator member may be configured to bear, or be pressed, at least partially against a free edge of the support. In another aspect, at least part of the applicator member may be spaced apart from the free edge of the support, for example, to form a chamber in which the substance may accumulate.

In accordance with various aspects of the invention, the applicator member may include a wall having a first face defining an applicator surface and a second face opposite the first face, and the support may be configured to bear against the second face of the wall. The support may then prevent the applicator member from being pushed in or depressed while the applicator member is being pressed against a surface being treated.

In one aspect of the invention, the applicator member may be circularly symmetrical. By way of example only, the applicator member may have an outside diameter ranging from approximately 12 millimeters (mm) to approximately 100 mm.

In another aspect, the applicator member may comprise at least one annular groove that may open radially towards the outside. This groove may impart greater flexibility to the applicator member.

In still another aspect of the invention, the retention skirt of the applicator member may be stationary relative to the receptacle. For example, the skirt may be fixedly held to the support by a suitable fixing mechanism, such as, for example, clamping, bonding, or gluing. Alternatively, the retention skirt may be movable relative to a portion of the receptacle.

According to various aspects, the applicator member may have a variety of shapes and forms. For example, an applicator surface (i.e., outer face) of the applicator member may be generally outwardly convex. Alternatively or additionally, the applicator surface may comprise at least one projection and/or depression. The applicator member may also have a conical, pyramid, or chamfered shape. The applicator surface may also extend in a direction that is substantially perpendicular to an axis along which the retention skirt may extend.

In some aspects of the invention, the applicator member may be compressible (e.g. elastically compressible). For example, the applicator member may comprise a foam that may be permeable to the substance. As used herein, the term "elastically compressible" refers to one or more material characteristics of the applicator member, which permit the applicator member to be elastically restored to its original shape after being substantially deformed during substance application. The applicator member may, in some exemplary embodiments, deform in the axial direction during, for example, application of the substance against a surface to be applied and/or during closure of the device. The applicator member may be elastically compressible in any direction.

According to yet still another aspect, the applicator member may comprise flocking. Where appropriate, the applicator member may contain a bactericidal or fungicidal agent.

In one aspect, the applicator member may or may not be made of a sintered material. For example, the applicator member may be made of a material including, but not limited to, PE, PP, PTFE, PVDF, EVA, Nylon 6, TPU, copolymer of PE, and PP (e.g., Porex®).

In some aspects of the invention, the device may comprise at least one cap for closing the receptacle. The cap may be arranged so as to be fastened in a leaktight manner on the receptacle. The cap may also be arranged such that the applicator member may be compressed when the cap is placed onto the receptacle.

In another aspect, the axis along which the retention skirt extends may coincide with a longitudinal axis of the receptacle. Alternatively, the axis may form a non-zero angle with respect to the longitudinal axis of the receptacle.

According to various aspects, the receptacle may include an outer wall, and the substance may be in contact with said outer wall. In a variant, the substance may be contained in a limp bag. In that case, the receptacle may comprise a flexible outer wall substantially enclosing the limp bag. The receptacle may comprise a first valve (e.g., an air admission valve) enabling air to enter (e.g., penetrate) into a space between the limp bag and the outer wall and a second valve (e.g., an outlet valve) enabling the substance to flow in one direction only towards the support and the applicator member. At least one of the first and second valves may comprise a check valve.

In various other aspects, the device may comprise a dispenser actuatable by a user to supply the substance to the applicator member. Such a dispenser may be selected from, for example, pumps and valves.

In still another aspect, the device may comprise a system for temporarily closing communication between the receptacle containing the substance and the applicator member. Such a closure system may comprise, for example, a check valve, a shut-off valve (e.g., on/off valve), or any other suitable valve known in the art.

In accordance with one aspect of the invention, the thickness of the retention skirt of the applicator member (as measured perpendicular to the axis X of the skirt) may be greater than the thickness of the part of the applicator member used to apply the substance (as measured along the axis X of the skirt). The thickness of the part used to apply the substance may vary depending on the nature of the substance. For example, the thickness may be smaller as the substance is more viscous.

The thickness of the retention skirt may be measured without radial compression thereof (e.g., before mounting on the device).

The applicator member may or may not bear against the feed chimney when the device is not in use and/or when the device is not closed with a cap. When the device is closed with a cap, the applicator member may or may not bear against the feed chimney.

In some aspects, the receptacle may contain a cosmetic product for application to a body, such as, for example, a cosmetic product to be applied to the chest or the legs. Alternatively or additionally, the receptacle may contain a makeup or care product, such as, for example, a sun-shield or tanning product (e.g., sunscreen or self-tanning product). The receptacle may also contain a product for hair care or for skin care.

Some aspects of the invention may provide a device for packaging and applying a substance, that may comprise a receptacle for containing the substance and an applicator member comprising a retention skirt configured to be fastened to the receptacle, said skirt extending in the direction of an axis and having a radial inner face. The receptacle may comprise a support in contact with the radial inner face of the retention skirt, and the support may contact the radial inner face of the skirt along at least a fraction of the support's height along the axis without contacting the radial inner face in every radial location with respect to the axis. The support may comprise a feed chimney having a non-circular cross-section.

In another aspect of the invention, a device for packaging and applying a substance may comprise a receptacle for containing the substance and an applicator member comprising a retention skirt configured to be fastened to the receptacle, said skirt extending in the direction of an axis and having a radial inner face, wherein the receptacle comprises a support in contact with the radial inner face of the retention skirt, wherein the support contacts the radial inner face of the skirt along at least a fraction of the support's height along the axis without contacting the radial inner face in every radial location with respect to the axis, and wherein the device comprises at least two feed chimneys.

In yet still another aspect, a device for packaging and applying a substance may comprise a receptacle for containing the substance and an applicator member comprising a retention skirt configured to be fastened to the receptacle, said skirt extending in the direction of an axis and having a radial inner face, wherein the receptacle comprises a support in contact with the radial inner face of the retention skirt, wherein the support contacts the radial inner face of the skirt along at least a fraction of the support's height along the axis without contacting the radial inner face in every radial location with respect to the axis, and wherein the support is fixed axially with respect to the receptacle.

In one aspect, a device for packaging and applying a substance may comprise a receptacle for containing the substance and an applicator member comprising a retention skirt configured to be fastened to the receptacle, said skirt extending in the direction of an axis and having a radial inner face, wherein the receptacle comprises a support extending in contact with the radial inner face of the retention skirt, wherein the support contacts the radial inner face of the skirt along at least a fraction of the support's height along the axis without contacting the radial inner face in every radial location with respect to the axis, and wherein the support comprises a feed chimney and lacks an upper transversal wall.

In some aspect, the device may further comprise a first space inside the receptacle for containing a supply of substance, a wall extending between the first space and the applicator member, at least one chimney extending from said wall and defining a second space inside the chimney, at least one orifice passing through the wall to permit substance flow between the first and second spaces, and a third space capable of being fed with substance and separated at least in part from the second space at least by the chimney. In some examples, the chimney may extend through the wall.

According to still another aspect of the invention, the device may comprise a first space inside the receptacle for containing a supply of substance, a wall extending between the first space and the applicator member, at least one chimney connected to said wall, a second space inside the chimney, and at least one orifice providing flow communication between the first and second spaces.

In some aspects, the device may further comprise a dispenser member actuatable by a user to feed the applicator member with the substance and/or a closure member for temporarily closing off flow communication between a space of the receptacle containing the substance and the applicator member.

Aside from the structural and procedural arrangements set forth above, the invention could include a number of other arrangements, such as those explained hereinafter. It is to be understood that both the foregoing description and the following description are exemplary.

The accompanying drawings, which are incorporated in and constitute a part of this specification, illustrate a number of non-limiting embodiments of the invention and, together with the description, serve to explain the principles of the invention.

Reference will now be made in detail to the exemplary embodiments of the invention, examples of which are illustrated in the accompanying drawings. Wherever possible, the same reference numbers will be used throughout the drawings to refer to the same or like parts. It is to be understood that both the foregoing general description and the following detailed description are exemplary and explanatory only and are not restrictive of the invention, as claimed.

Figure 1:
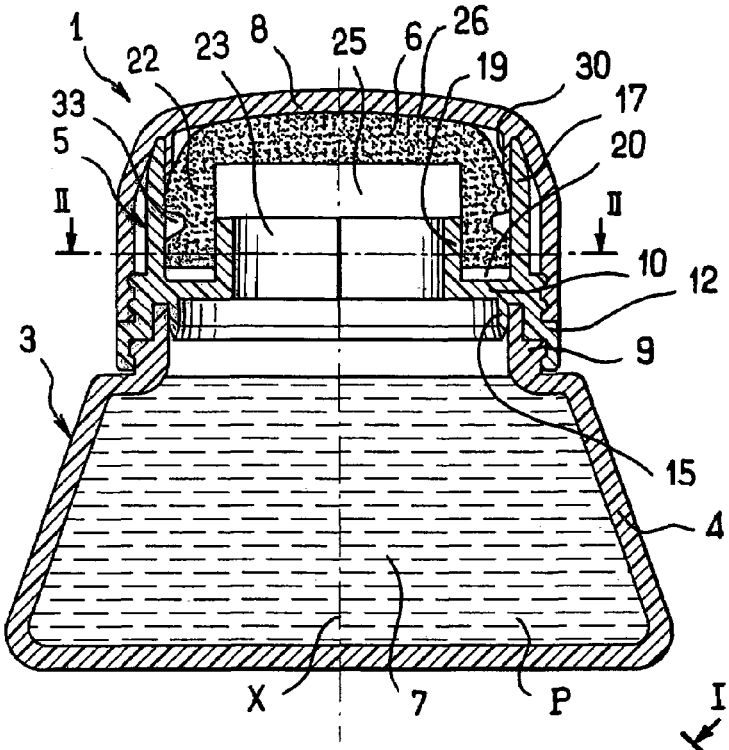
FIG. 1 is an axial cross-section view of a device for packaging and applying a substance, according to an exemplary embodiment of the invention.

FIG. 1 shows a device 1 comprising a receptacle 3 having a body 4. The receptacle 3 may comprise a neck 9 extending from the body 4 about an axis X, to which a support 5 carrying an applicator member 6 may be fastened. In a variant, the support 5 may be integrally formed with at least a portion of the body 4 by molding, for example, a thermoplastic material.

The body 4 may define a first space 7 for containing a substance P. The substance P may be a liquid or a powder. In some exemplary embodiments, the substance P may be a cosmetic or care product.

The applicator member 6 may be made of a porous material. For example, the applicator member 6 may comprise a cellular material, such as a foam having open or semi-open cells. Materials suitable for such a foam may include, but not be limited to, polyethylene, polyvinyl chloride, polyether, polyester, acrylonitrile butadiene rubber, and styrene butadiene rubber. Any other material known in the art may also be used alternatively or additionally.

The device 1 may also include a cap 8 or any other suitable closure member associated with the support 5 and/or the body 4 of the receptacle 3. For example, as shown in FIG. 1, the support 5 may include an outer skirt 17, and the cap 8 may be screw-fastened or snap-fastened onto the outer skirt 17. This cap 8 may bear in a leaktight manner against the support 5. For this purpose, the cap 8 may include an annular sealing lip 30 bearing against the radial inner face of the outer skirt 17, for example.

In various exemplary embodiments, the support 5 may include a transverse wall 10 extending across the axis X. The support 5 may also be provided at its periphery with a rim 12 (e.g., annular rim) that may be snap-fastened or screw-fastened against an annular bead of the neck 9.

The support 5 may also include a feed chimney 19 that may provide a flow passage therethrough for supplying the substance P from the receptacle 3 to the applicator member 6. The chimney 19 may extend along the axis X. The chimney 19 may be connected at its bottom end to the transverse wall 10 and surrounded by the outer skirt 17 to form an annular groove 20, in which at least part of a retention skirt 22 of the applicator member 6 may be received, to fasten the applicator member 6 to the support 5.

The applicator member 6 may include a top wall 26, from which the retention skirt 22 may extend, as shown in FIG. 1. The retention skirt 22 may be integrally formed with the top wall 26. Alternatively, the retention skirt 22 may be a separate element and may be secured to the top wall 26. The outer surface of this wall 26 may define an applicator surface. The inner surface, opposite the outer surface, may define, in cooperation with the support 5, a portion of a chamber 25.

The feed chimney 19 may define a channel 23 through which the substance P contained in the body 4 of the receptacle 3 may pass to reach to the chamber 25. The substance P reached to the chamber 25 may then be used to feed the applicator member 6.

The applicator member 6 may be in flow communication with the supply of substance P in the receptacle 3 without any intervening valve therebetween. In some exemplary embodiments, there may be a flow controller (e.g., a valve, a pump, and/or a closure) disposed between the applicator member 6 and the receptacle 3. For example, as will be described herein below, the device 1 may include an actuatable valve or closure mechanism, by which the substance P may be fed to the applicator member. Such a valve or closure mechanism may serve, for example, to prevent substance P from reaching the applicator member 6 while the device 1 is being carried, for example, in a handbag.

The applicator member 6 may be made in a variety of shapes, forms, and sizes. For example, the retention skirt 22 may include a peripheral annular groove 33, as shown in FIG. 1.

Figure 2:
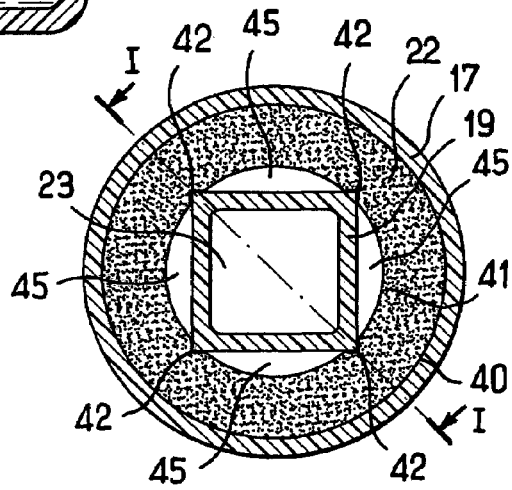
FIG. 2 is a cross-section view of the device shown in FIG. 1 along the elevational level II-II.

The outer skirt 17 may be generally circular in shape and symmetrical about the axis X, as shown in, for example, FIG. 2. The retention skirt 22 of the applicator member 6 may have an outer face 40 that may also be generally circular in shape and symmetrical about the axis X. The outer face 40 may come into contact with the outer skirt 17 around its entire circumference. The retention skirt 22 may also have an inner face 41 (e.g., facing radially inwardly about the axis X), opposite the outer face 40, that may be configured to contact the chimney 19. In various exemplary embodiments, the support may contact the radial inner face 41 of the skirt 22 along at least a fraction of the support's height along the axis without contacting the radial inner face 41 in every radial location with respect to the axis. To provide one example, the inner face 41 of retention skirt 22 may contact the chimney 19 with less than the entire circumference (or perimeter if the inner face 41 has a non-circular shape) of the inner face 41. For example, as shown in the cross-section view of FIG. 2, the chimney 19 may have a square cross-section and may contact the inner face 41 of the retention skirt 22 with four corner edges 42 without making contact at locations between those corner edges 42. The retention skirt 22 may be held in place at least by being clamped between the feed chimney 19 and the outer skirt 17 along the edges 42.

Figure 3:
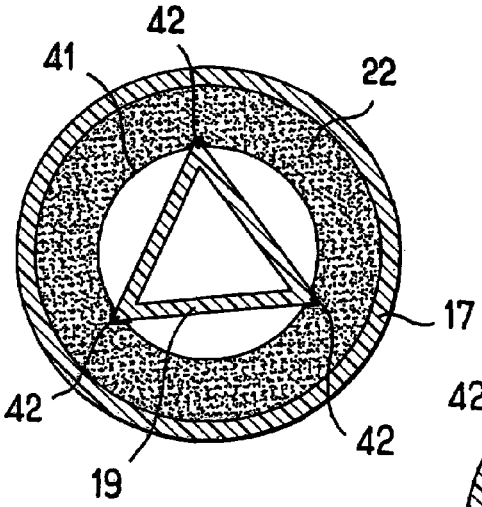
FIGS. 3 and 4 are cross-section views analogous to FIG. 2, illustrating other various exemplary embodiments of the device.
Figure 4:
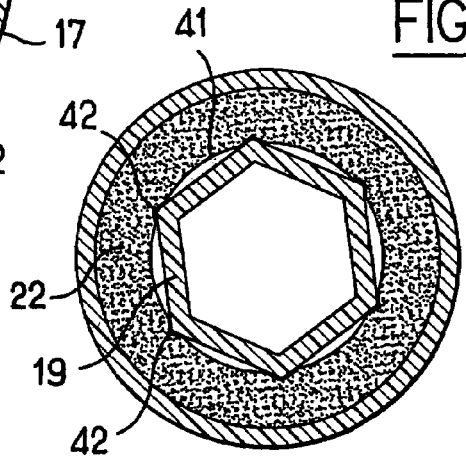

The feed chimney 19 may have a variety of different shapes. For example, as shown in FIG. 3, the chimney 19 may have a triangular cross-section that may contact the inner face 41 of the retention skirt 22 via three corner edges 42. Similarly, in another exemplary embodiment, the chimney 19 may have a hexagonal cross-section, as shown in FIG. 4. It should be understood that the chimney 19 may also have any other regular or irregular polygonal shape.

As shown in FIGS. 2-4, spaces 45 may extend between the chimney 19 and the retention skirt 22. These spaces 45 may be closed at their bottom ends by a transverse wall 10. In a variant, these spaces 45 may communicate, through orifices formed in the transverse wall 10, with the space 7 inside the receptacle 3 for containing the supply of substance P. The orifices may permit a flow of the substances from the space 7 of the receptacle 3 to the spaces 45 when the receptacle 3 is arranged in a head-down position. The orifices may also enable the substance present in the spaces 45 to flow back to the receptacle under gravity when the receptacle is arranged in a head-up position.

Figure 5:
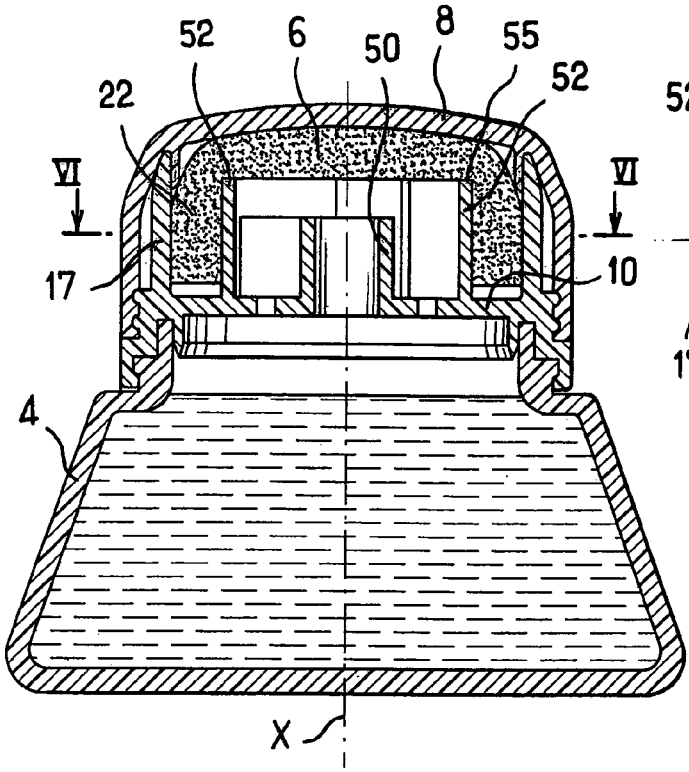
FIG. 5 is an axial cross-section view of a device for packaging and applying a substance, according to another exemplary embodiment of the invention.
Figure 6:
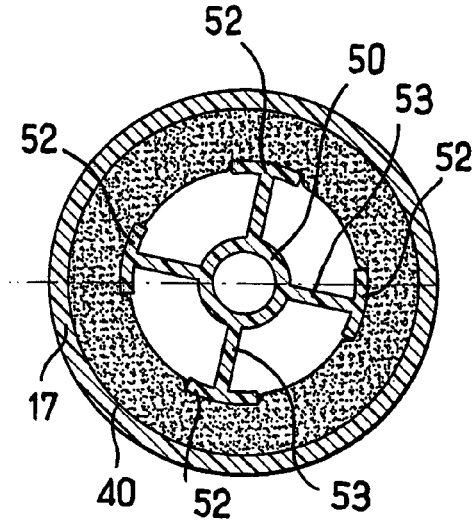
FIG. 6 is a cross-section view of the device shown in FIG. 5 along the elevational level VI-VI.

According to another exemplary embodiment of the invention, the feed chimney 50 may be spaced apart from the retention skirt 22, as shown in FIGS. 5 and 6. In this exemplary embodiment, the skirt 22 may be clamped between the inner face 40 of the outer skirt 17 and uprights 52, where the uprights 52 may press radially against the inner surface 41 of the retention skirt 22. The uprights 52 may be connected to the chimney 50 via one or more lateral extensions 53 (e.g., walls) extending radially therebetween. The uprights 52 may have their bottom ends connected to the transverse wall 10.

As shown in FIG. 5, the uprights 52 may have a height that is different from the height of the chimney 50. The top edges 55 of the uprights 52 may also be configured to bear against the applicator member 6. In an exemplary embodiment, the height of the uprights 52 may be the same as that of the chimney 50. In another exemplary embodiment, at least one of the uprights 52 may be different from the other of the uprights 52.

The distance between the top end (e.g., free end) of the chimney 50 and the applicator member 6 may be sufficiently small or non-existent. This arrangement may allow the chimney 50 to adequately support the applicator member 6 during application (e.g., when the wall 26 of the applicator member 6 becomes depressed due to a contact pressure exerted by the surface being treated).

Figure 7:
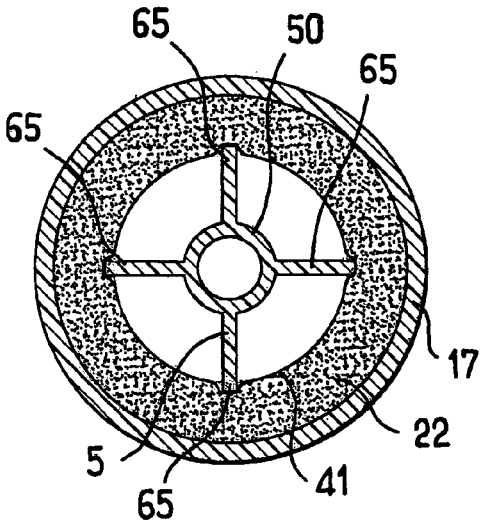
FIGS. 7 and 8 are cross-section views analogous to FIG. 6, illustrating other various exemplary embodiments of the device.

Various other arrangements may be provided for holding the retention skirt 22 of the applicator member 6 between the support 5 and the outer skirt 17. For example, as shown in FIG. 7, the support 5 may comprise one or more radial fins 65 extending from the feed chimney 50 to contact the inner face 41 of the retention skirt 22. The radial fins 65 may also be connected to the transverse wall 10 at their bottom ends.

Figure 8:
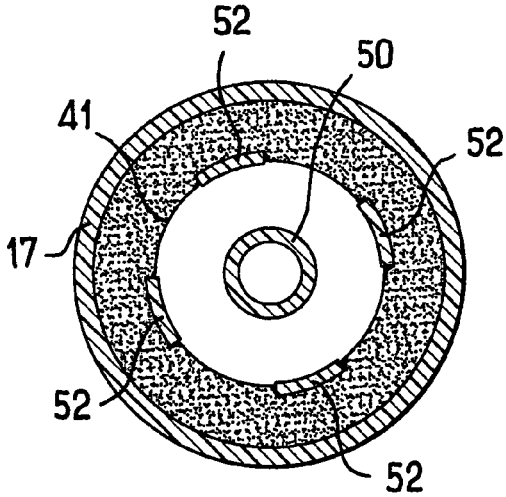

In a variant, the uprights 52 may not include the extensions 53, such as those shown in FIG. 6. Instead, as shown in FIG. 8, the uprights 52 may be connected only to the transverse wall 10. In this arrangement, the uprights 52 may be sufficiently rigid and provide adequate radial force against the inner face 41 of the applicator member.

Figure 9:
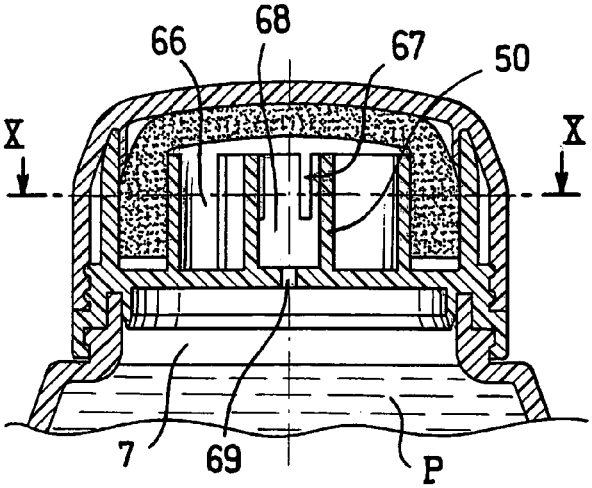
FIG. 9 is a partial, axial cross-section view of a device for packaging and applying a substance, according to still another exemplary embodiment of the invention.
Figure 10:
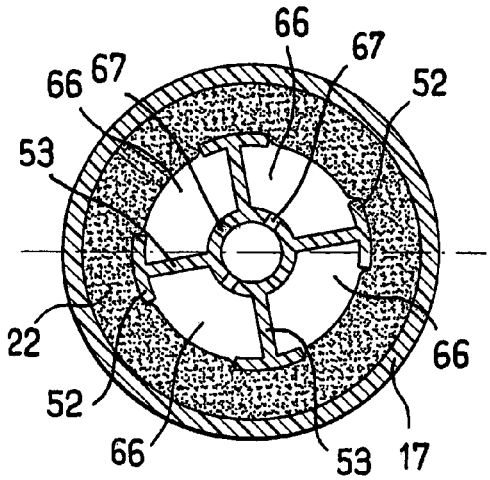
FIG. 10 is a cross-section view of the device shown in FIG. 9 along the elevational level X-X.

According to still another exemplary embodiment, the feed chimney 50 may comprise one or more openings 67 (e.g., slots) for permitting flow communication between the inside channel 68 of the chimney 50 and one or more spaces 66 defined by two adjacent extensions 53 (e.g., partition walls) and the retention skirt 22. For example, as shown in FIGS. 9 and 10, the feed chimney 50 may comprise one or more axial slots 67 extending over at least a fraction of the height of the chimney 50. In an exemplary embodiment, the slots 67 may open out to the free end of the chimney 50. The slots 67 may facilitate flow of the substance P from the chimney 50 to the spaces 66 so that the substance can be delivered to a larger area of the applicator member 6.

Still referring to FIG. 9, it may be possible to have the inside channel 68 of the chimney 50 communicate with the space 7 inside the receptacle 3 via an orifice 69. The diameter of the orifice 69 may be smaller than the inner diameter of the chimney 50.

In various exemplary embodiments, the spaces 66 may communicate with the space 7 of the receptacle 3 solely via the chimney 50 and the openings or slots 67, as shown in FIGS. 9 and 10.

Figure 11:
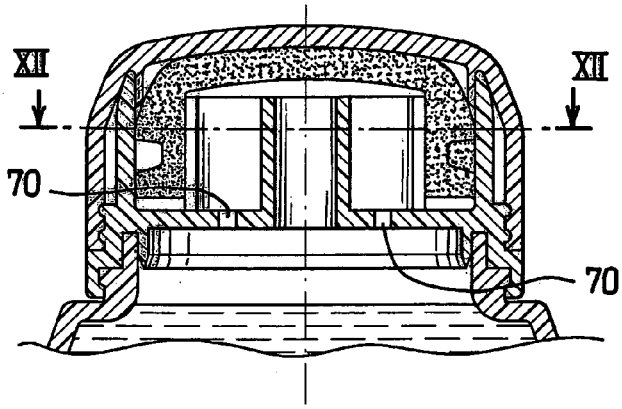
FIG. 11 is a partial, axial cross-section view of a device for packaging and applying a substance, according to yet still another exemplary embodiment of the invention.
Figure 12:
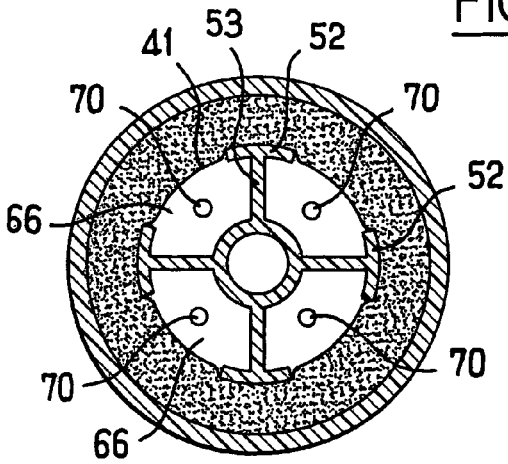
FIGS. 12 and 13 are cross-section views of the device shown in FIG. 11 along the elevational level XII-XII, illustrating various exemplary embodiments.

Alternatively or additionally, the spaces 66 may directly communicate with the space 7 via one or more openings (e.g., orifices or passages) defined in the transverse wall 10. For example, as shown in FIGS. 11 and 12, orifices 70 may be formed through the transverse wall 10 so as to enable the spaces 66 to communicate directly with the space 7 containing the substance P.

Figure 13:
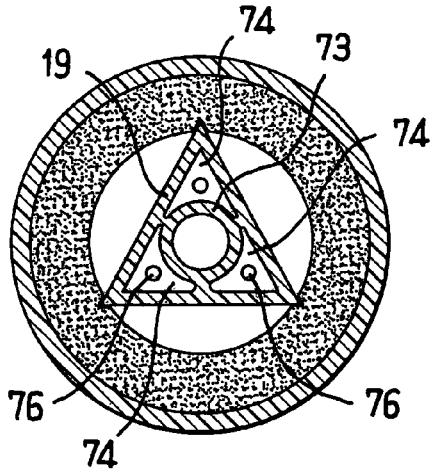

According to other various exemplary embodiments of the invention, the support 5 may comprise a plurality of feed chimneys. For example, as shown in FIG. 13, the support may comprise a first chimney 19 and a second chimney 73 positioned inside the first chimney 19. The spaces 74 defined between the two chimneys 19, 73 may be closed by the transverse wall 10. Alternatively, at least one of the spaces 74 may communicate with the space 7 of the receptacle 3 via one or more openings 76 (e.g., orifices) of the transverse wall 10.

Figure 14:
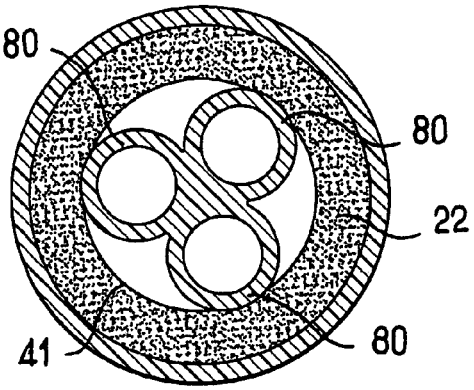
FIGS. 14-16 are cross-section views analogous to FIGS. 12 and 13, illustrating other various exemplary embodiments of the device.

Referring to FIG. 14, the support 5 may comprise a plurality of chimneys disposed side by side. By way of example, FIG. 14 shows three adjacent chimneys 80 with each having its independent axis along which each extends axially. The three axes may define the vertices of a triangle, and the chimneys 80 may define at least one generator line that may bear against the radial inner face 41 of the retention skirt 22.

Figure 15:
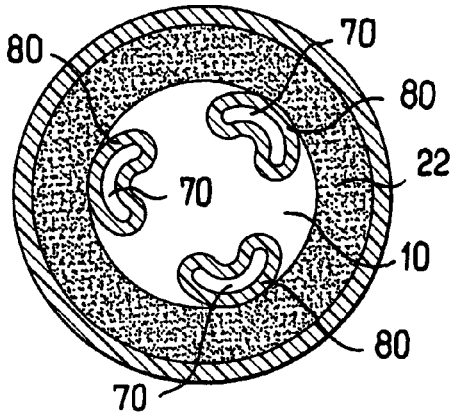
Figure 16:
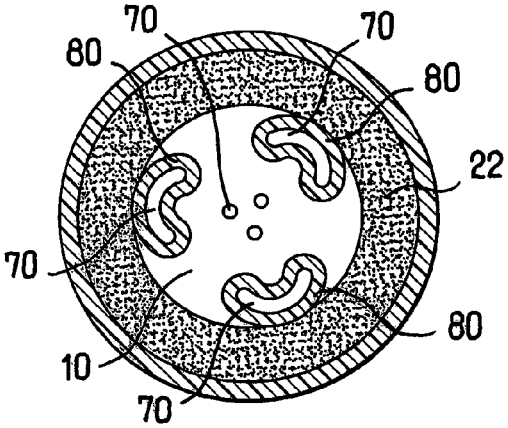

As shown in, for example, FIGS. 15 and 16, the chimneys 80 may not be in contact with one another.

The transverse wall 10 may comprise at least one opening (e.g., orifice) each corresponding to the respective chimney 80. The flow area of the opening may be substantially equal to or less than the flow area of the chimneys 80. Alternatively or additionally, the transverse wall 10 may include at least one opening 70 in its central region other than the region occupied by the chimneys 80, as shown in FIG. 16.

Figure 17:
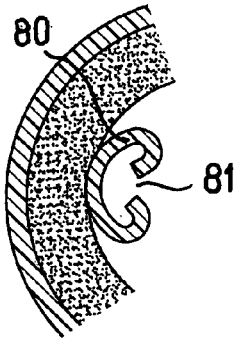
FIG. 17 is a partial cross-section view analogous to FIGS. 14-16, illustrating a variant embodiment of a chimney.

It should be understood that the cross-sectional shape of the chimneys 80 is not limited to the circular shape of FIG. 14 or the kidney-like shape of FIGS. 15 and 16. Instead, any other shapes or variations thereof may also be possible. For example, at least one of the chimneys 80 may include a lateral slot 81, as shown in FIG. 17.

Figure 18:
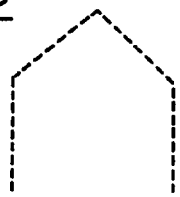
FIGS. 18 and 19 are schematic illustrations of enveloping profiles of chimneys, according to an exemplary embodiment of the invention.
Figure 19:
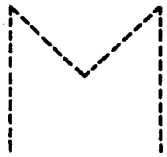

When the support 6 comprises a plurality of chimneys, the top edges of the chimneys may define an outer profile. For example, the top edges of the chimneys may define a projecting conical portion, as shown in FIG. 18, or a depressed conical portion, as shown in FIG. 19.

Figure 20:
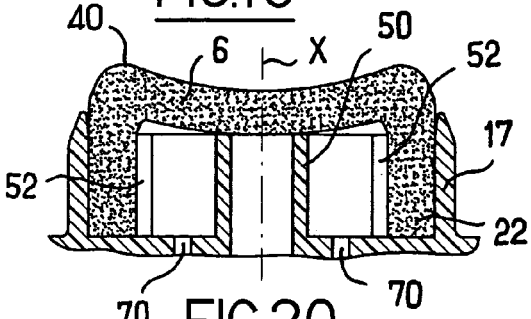
FIGS. 20 to 24 are partial cross-section views of a device for packaging and applying a substance, illustrating various exemplary embodiments of an applicator member and a support.
Figure 21:
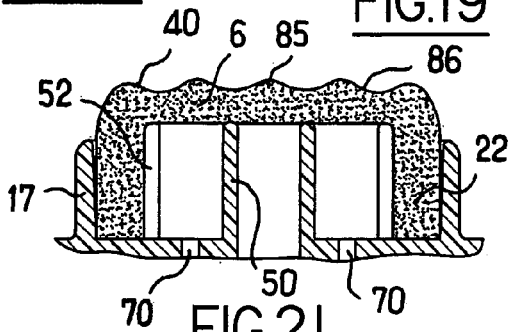
Figure 22:
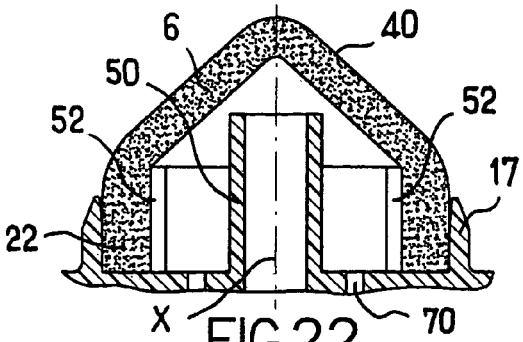
Figure 23:
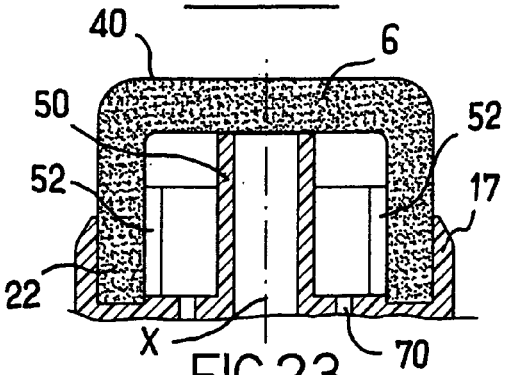
Figure 24:
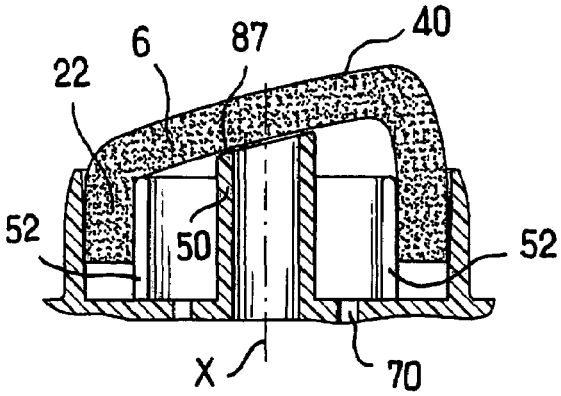

According to an aspect of the invention, the applicator member 6 may have a variety of shapes. For example, in addition to the generally convex shapes shown in FIGS. 1, 5, 9, and 11, the outer face 40 of the applicator member 6 may have a shape that is generally concave with respect to the axis X of the chimney 50, as shown in FIG. 20. In other various exemplary embodiments, the outer face 40 of the applicator member 6 may have: for example, at least one alternating projection 85 and depression 86, as shown in FIG. 21; a substantially conical or pyramid-shaped applicator face, as shown in FIG. 22; a generally flat applicator face (e.g., at least in a central region) that is substantially perpendicular to the axis X, as shown in FIG. 23; or a chamfered surface defining a sloping applicator face that forms an oblique angle relative to the axis X, as shown in FIG. 24.

The chimney 50 may have a height that is different from the height of the adjacent chimney or uprights 52. For example, as shown in FIGS. 22 and 23, the height of the chimney 50 may be greater than the adjacent uprights 52. This arrangement may avoid a suction effect when the applicator member is compressible and/or is compressed and released against the chimney 50.

The free end of the chimney 50 may define a slanted edge 87 extending in a plane that may intersect with the axis X of the chimney 50 obliquely. Alternatively, the free end of the chimney 50 may define any other shape or form.

Figure 25:
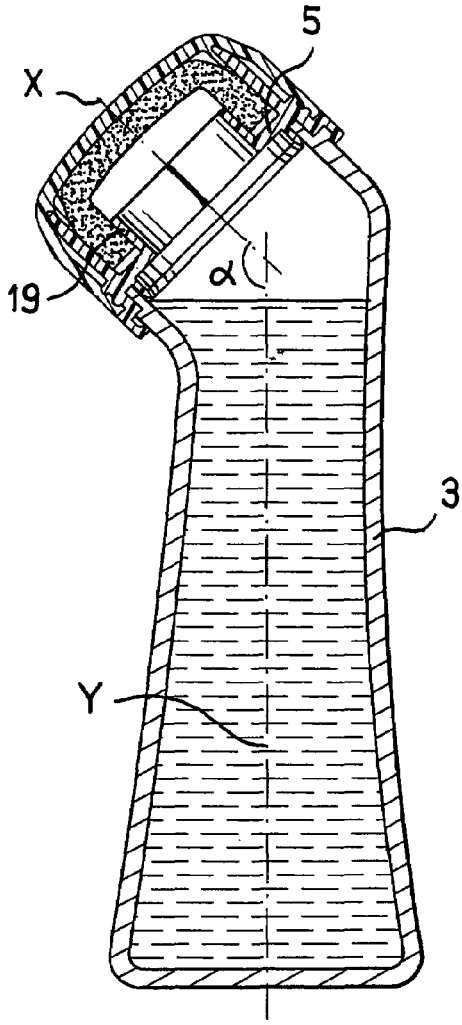
FIGS. 25 and 26 are axial cross-section views of a device for packaging and applying a substance, according to various exemplary embodiments of the invention.

According to still another aspect, the receptacle 3 may have a variety of shapes. For example, the receptacle 3 may have a shape that may facilitate holding or grasping of the receptacle 3 and/or application of the substance to the body. In an exemplary embodiment, the longitudinal axis Y of the receptacle 3 may form a non-zero angle $\alpha$ relative to the axis X along which the retention skirt 22 (or the chimney 50) may extend, as shown in FIG. 25. The receptacle 3 of FIG. 25 may be fitted with one of the dispenser heads shown in, for example, FIGS. 1-16. Moreover, the applicator member 6 shown in FIG. 25, as well as those shown in FIGS. 1-16, may be replaced by one of the applicator members 6 shown in FIGS. 20-24.

The receptacle 3 may have a flexible wall 83 so as to allow an elastic deformation of the receptacle 3. For example, the receptacle 3 may be made of a material having shape memory so that, when the receptacle 3 is deformed, the receptacle 3 may elastically restore its original shape. Such a flexible wall may enable a user to dispense the substance P out of the receptacle 3 by squeezing the receptacle 3 (e.g., reducing the internal volume of the receptacle so as to increase the pressure inside the receptacle 3), thus making it easier for the substance P to flow through the applicator member 6.

Figure 26:
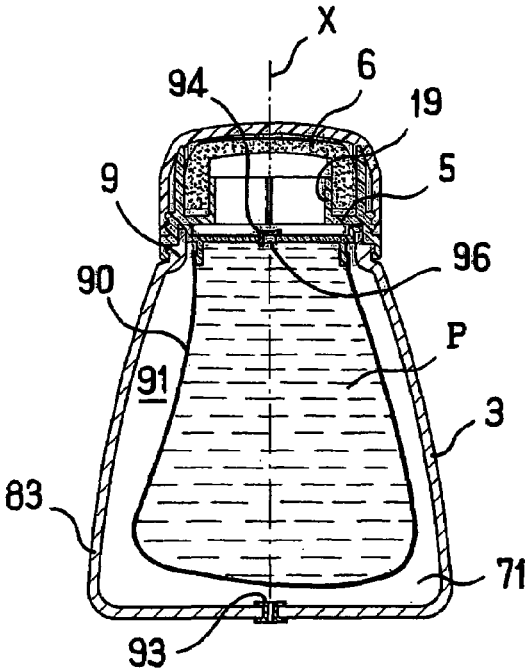

The substance P may be contained in a limp bag 90, as shown in FIG. 26, which may be situated inside the receptacle 3. The space 91 between the bag 90 and the wall 83 of the receptacle 3 may communicate with the outside of the receptacle 3 through an air inlet valve 93 (e.g., a check valve) that, as will be described below, may selectively permit in-flow of air therethrough into the space 91 when a suction condition is established inside the space 91. The bag 90 may be coupled to an end piece 94 disposed adjacent the neck 9 of the receptacle 3. In an exemplary embodiment, the end piece 94 may be held in the neck 9 by the support 5. The end piece 94 may include another check valve 96 (e.g., a substance-outlet check valve) that may selectively permit out-flow of the substance P therethrough out of the bag 90 when extra pressure is created inside the bag 90. At least one of the valves 93, 96 may be made of an elastomer material by, for example, overmolding.

In operation, when a user squeezes the flexible wall 83 of the receptacle 3, the volume of the inside space 91 may decrease, causing the pressure inside the bag 90 to increase. The pressure increase in the bag 90 may actuate the outlet valve 96 to open, causing the substance to be expelled to the applicator member 6 through the outlet valve 96. During the squeezing, the air inlet valve 93 may be maintained in a closed state. When the user releases the wall 83, the outlet valve 96 may be closed with the bag 90 remaining in the reduced volume since the outlet valve 96 only permits one-way flow (e.g., outflow of the substance). Furthermore, a suction condition may be established inside the space 91 due to the reduced volume of the bag 90 and the elasticity of the flexible wall 83. The suction condition inside the space 91 may actuate the air inlet valve 93 to open, allowing in-flow of air into the space 91 to bring the pressure back to its equilibrium pressure.

Figure 27:
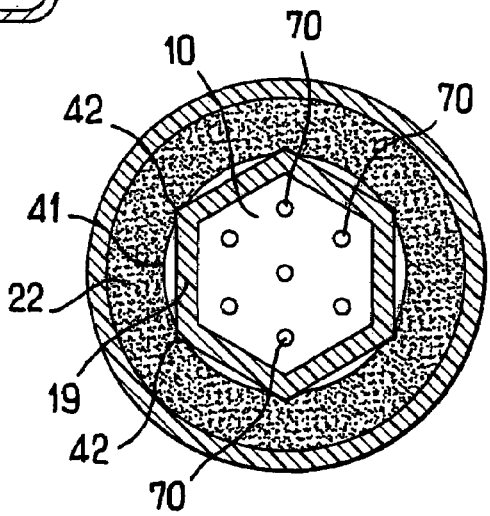
FIG. 27 is a cross-section view analogous to FIG. 4, illustrating a variant embodiment.

In an exemplary embodiment shown in FIG. 27, the inside space of the chimney 19 may communicate with the supply of substance P via a plurality of openings 70 (e.g., orifices) formed through the transverse wall 10. This arrangement may provide an additional head loss.

Figure 28:
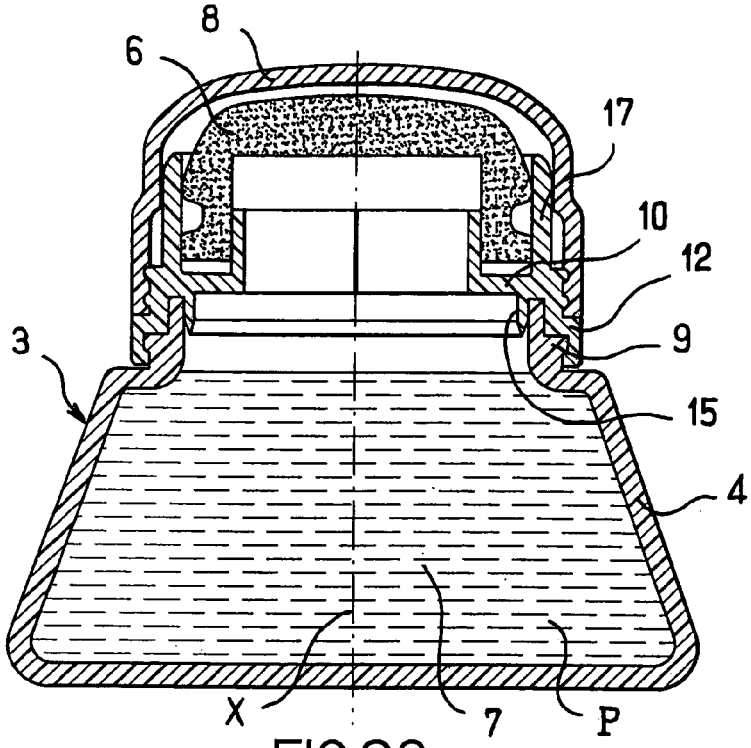
FIG. 28 is an axial cross-section view of a device for packaging and applying a substance, according to still another exemplary embodiment of the invention.

According to another aspect, the cap 8 may be configured such that the cap 8 does not contact the applicator member 6 when the cap 8 is placed on the receptacle 3, as shown in FIG. 28. Leak-tight closure of the receptacle 3 may be achieved by, for example, the cap 8 pressing against the outer surface of the outer skirt 17 and/or any other suitable portion of the support 5.

In one or more exemplary embodiments described above, the substance P may be supplied to the applicator member 6 by turning the receptacle 3 in a head-down position and/or by shaking the receptacle 3.

Figure 29:
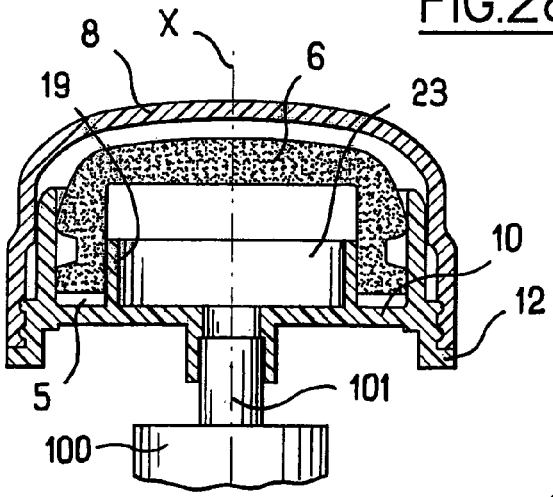
FIG. 29 is a partial, axial cross-section view of a device for packaging and applying a substance, according to still another exemplary embodiment of the invention.

Alternatively or additionally, the device may comprise a suitable dispensing member that may be actuatable by a user to dispense the substance P out of the receptacle 3. For example, as shown in FIG. 29, the device may comprise a dispensing member 100, such as, for example, a pump, a valve, or any other suitable flow controller mechanism known in the art. The support 5 or the neck 9 of the receptacle 3 may be appropriately configured to accommodate such a dispensing member. For example, the support 5 may be arranged to cooperate with an actuator rod 101 of the dispensing member 100, as shown in FIG. 29, such that, when the rod 101 is displaced (e.g., by being depressed along the axis X against the support 5), the dispensing member 100 may be actuated to deliver the substance to the applicator member 6 via, for example, the channel 23 of the chimney 19. In various exemplary embodiments, the substance P contained within the receptacle 3 may be in a pressurized form.

It may also be possible to provide a temporary closure system for closing the flow communication between the supply of substance P contained in the receptacle 3 and the applicator member 6.

Figure 30:
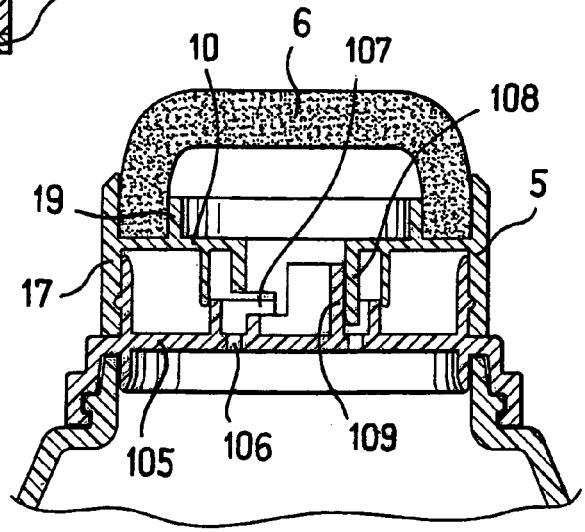
FIG. 30 is a partial, axial cross-section view of a device for packaging and applying a substance, according to another exemplary embodiment of the invention, illustrating a flow controller system for controlling the flow communication between an applicator member and a supply of substance.

In still another exemplary embodiment of the invention, the support may constitute two or more interacting parts, where at least one of the parts may be movable relative to the other of the parts or the receptacle 3. By way of non-limiting example, FIG. 30 shows one part 5 of a support that may be rotatably movable relative to another part 105 of the support, where the part 105 is fixedly coupled to the neck 9 of the receptacle 3. The fixed part 105 may have a transverse wall having at least one opening 106 passing therethrough and a concentric skirt 109 defining, in cooperation with another concentric skirt 108 of the movable part 5, an opening 107. The openings 106, 107 may define a passage through which the substance P may be delivered to the applicator member 6. The movable part 5 may be moved between a closed position and an open position to close and open the passage (e.g., the opening 107), respectively. For example, to close the passage, the movable part 5 may be rotated with respect to the fixed part 105 such that the skirt 108 of the movable part 5 may engage the skirt 109 of the fixed part 105 to close the opening 107. To open the passage, the movable part 5 may be rotated to open the opening 107, as shown in FIG. FIG. 30. Alternatively or additionally, a suitable closure system may be arranged so that opening and closing of the passage may be achieved by, for example, moving the movable part 5 axially relative to the fixed part 105.

In some exemplary embodiments, the applicator member 6 may be made of a material other than a foam. For example, the applicator member 6 may be made of a felt, a sponge, or a sintered plastic or inorganic material. The applicator member 6 may constitute a one-piece structure or a multi-layer structure. The surface of the applicator member 6 may include, for example, flocking or a piece of woven or non-woven fabric.

In some exemplary embodiments, the transverse wall 10 may have a variety of shapes and/or forms. For example, the transverse wall 10 may constitute no more than simple bridges of material.

In some exemplary embodiments, the chimney 19, 50 may be continuous or non-continuous in the radial direction (e.g., circumferential direction if the chimney is circular), and, where appropriate, may include portions that are of differing heights and/or of differing radial extents.

Throughout the description, including the claims, the term "a" should be understood as being synonymous with "at least one" (i.e., relating to both the singular and the plural) unless specified to the contrary.

It will be apparent to those skilled in the art that various modifications and variations can be made to the structure and methodology of the present invention. Thus, it should be understood that the invention is not limited to the examples discussed in the specification. Rather, the present invention is intended to cover modifications and variations.

What is claimed is:

1. A device for packaging and applying a substance, the device comprising:

a receptacle for containing the substance; and an elastically compressible applicator member comprising a retention skirt configured to be fastened to the receptacle, said skirt extending in the direction of an axis and having a radial inner face, wherein the receptacle comprises a support in contact with the radial inner face of the retention skirt, wherein the support contacts the radial inner face of the skirt along at least a fraction of the support's height along the axis without contacting at least one radial location in the radial inner face, and wherein the support does not contact the radial inner face entirely along the axis in the at least one radial location.

2. The device according to claim 1, wherein the radial inner face of the retention skirt is circularly symmetrical about the axis.

3. The device according to claim 1, wherein the support comprises a feed chimney having a non-circular cross-section that is configured to bear against the radial inner face of the retention skirt.

4. The device according to claim 3, wherein the cross-section of the chimney has a shape of a polygon.

5. The device according to claim 4, wherein the chimney comes into contact with the retention skirt via corner edges of the polygon.

6. The device according to claim 3, wherein the cross-section of the chimney has a shape of a triangle, square, or hexagon.

7. The device according to claim 3, wherein the support comprises another chimney inside the feed chimney.

8. The device according to claim 1, wherein the support comprises one or more uprights extending in contact with the inner face of the retention skirt.

9. The device according to claim 8, wherein the one or more uprights are connected to a feed chimney by one or more radially extending walls.

10. The device according to claim 8, wherein the uprights constitute portions of a cylinder.

11. The device according to claim 8, wherein the uprights constitute coaxial cylinder portions.

12. The device according to claim 1, wherein the support comprises radial fins having respective radially outer edges bearing against the radial inner face of the retention skirt.

13. The device according to claim 12, wherein the fins are connected to a feed chimney.

14. The device according to claim 1, wherein the support comprises at least two feed chimneys, each of the chimneys being configured to bear against the radial inner face of the retention skirt via at least one generator line.

15. The device according to claim 14, wherein the support comprises at least three feed chimneys.

16. The device according to claim 1, wherein the retention skirt comprises a radial outer face opposite the radial inner face, and the support comprises an outer skirt configured to at least partially contact the radial outer face.

17. The device according to claim 1, wherein the support comprises a part configured to be fitted onto a body of the receptacle.

18. The device according to claim 1, wherein the applicator member is circularly symmetrical.

19. The device according to claim 18, wherein the applicator member has an outside diameter ranging from approximately 12 mm to approximately 100 mm.

20. The device according to claim 1, wherein the support is made integrally with the receptacle by molding a plastic material.

21. The device according to claim 1, wherein the support comprises a fastening member configured to engage with a neck of the receptacle.

22. The device according to claim 1, wherein the applicator member is configured to bear at least partially against a free edge of the support.

23. The device according to claim 1, wherein the applicator member is spaced apart at least partially from a free edge of the support.

24. The device according to claim 1, wherein the applicator member comprises at least one annular groove that is open radially towards the outside.

25. The device according to claim 1, wherein the retention skirt is stationary relative to the receptacle.

26. The device according to claim 1, wherein the retention skirt is movable relative to a portion of the receptacle.

27. The device according to claim 1, wherein the applicator member comprises a foam.

28. The device according to claim 1, further comprising at least one cap for closing the receptacle.

29. The device according to claim 28, wherein the cap is arranged so as to be fastened in leaktight manner on the receptacle.

30. The device according to claim 1, wherein the axis along which the retention skirt extends coincides with a longitudinal axis of the receptacle.

31. The device according to claim 1, wherein the axis along which the retention skirt extends forms a non-zero angle with respect to a longitudinal axis of the receptacle.

32. The device according to claim 1, wherein the receptacle comprises an outer wall, and the substance is in contact with said outer wall.

33. The device according to claim 1, wherein the substance is contained in a limp bag.

34. The device according to claim 33, wherein the receptacle comprises a flexible outer wall substantially enclosing the limp bag.

35. The device according to claim 34, wherein the receptacle comprises a first valve enabling air to enter into a space between the limp bag and the outer wall and a second valve enabling the substance to flow in one direction only towards the support and the applicator member.

36. The device according to claim 35, wherein at least one of the first and second valves comprises a check valve.

37. The device according to claim 1, wherein the receptacle contains a cosmetic product.

38. The device according to claim 1, comprising:

a first space inside the receptacle for containing a supply of substance;

a wall extending between the first space and the applicator member;

at least one chimney extending from said wall and defining a second space inside the chimney;

at least one orifice passing through the wall to permit substance flow between the first and second spaces; and a third space capable of being fed with substance and separated at least in part from the second space at least by the chimney.

39. The device according to claim 1, comprising:

a first space inside the receptacle for containing a supply of substance;

a wall extending between the first space and the applicator member;

at least one chimney connected to said wall;

a second space inside the chimney; and at least one orifice providing flow communication between the first and second spaces.

40. The device according to claim 1, further comprising a dispenser member actuatable by a user to feed the applicator member with the substance.

41. The device according to claim 1, comprising a closure member for temporarily closing off flow communication between a space of the receptacle containing the substance and the applicator member.

42. The device according to claim 1, wherein the support is fixed axially with respect to the receptacle.

43. The device according to claim 1, wherein the support comprises a feed chimney extending at least above the bottom of the skirt.

* * * * *